US007004760B2

(12) United States Patent
Kawazoe et al.

(10) Patent No.: US 7,004,760 B2
(45) Date of Patent: Feb. 28, 2006

(54) CONNECTOR AND AN ELECTRONIC APPARATUS HAVING ELECTRONIC PARTS CONNECTED TO EACH OTHER BY THE CONNECTOR

(75) Inventors: Katsuro Kawazoe, Hadano (JP); Takayuki Uda, Hadano (JP); Kouichi Yamamoto, Hadano (JP); Tsutomu Sakamoto, Hadano (JP); Maria Katsuki, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/740,545

(22) Filed: Dec. 22, 2003

(65) Prior Publication Data

US 2005/0020116 A1 Jan. 27, 2005

(30) Foreign Application Priority Data

Dec. 24, 2002 (JP) ..... 2002-371723

(51) Int. Cl.
*H01R 12/00* (2006.01)

(52) U.S. Cl. ..... 439/66; 439/91

(58) Field of Classification Search ..... 439/66–67, 439/91, 331

See application file for complete search history.

(56) References Cited

U.S. PATENT DOCUMENTS

| | | | | |
|---|---|---|---|---|
| 3,881,799 | A * | 5/1975 | Elliott et al. | 439/816 |
| 5,427,535 | A * | 6/1995 | Sinclair | 439/66 |
| 5,531,022 | A * | 7/1996 | Beaman et al. | 29/850 |
| 5,984,691 | A * | 11/1999 | Brodsky et al. | 439/66 |
| 6,050,832 | A * | 4/2000 | Lee et al. | 439/91 |
| 6,168,442 | B1 * | 1/2001 | Naoi | 439/91 |
| 6,303,408 | B1 * | 10/2001 | Smith | 438/106 |
| 6,477,058 | B1 * | 11/2002 | Luebs et al. | 361/784 |
| 6,849,935 | B1 * | 2/2005 | Palanisamy | 257/678 |

FOREIGN PATENT DOCUMENTS

| | | |
|---|---|---|
| JP | 6-104035 | 4/1994 |
| JP | 7-263620 | 10/1995 |
| JP | 8-306697 | 11/1996 |
| JP | 10-199641 | 7/1998 |
| JP | 2000-022034 | 1/2000 |
| JP | 2001-093635 | 4/2001 |
| JP | 2001-167831 | 6/2001 |
| JP | 2002-171066 | 6/2002 |

* cited by examiner

*Primary Examiner*—Michael C. Zarroli
(74) *Attorney, Agent, or Firm*—Antonelli, Terry, Stout & Kraus, LLP.

(57) ABSTRACT

A connector is used for connecting a plurality of first terminals formed on a first electronic part to a plurality of respective second terminals formed on a second electronic part. The connector comprises an intermediate basis material having a spring characteristic, a plurality of first electrically conductive members provided on a first surface of the intermediate basis material, a plurality of second electrically conductive members provided on a second surface of the intermediate basis material, and wiring for connecting each of the first electrically conductive members to a corresponding one of the second electrically conductive members. Such electrically-conductive members may be columnar, tubular, spherical, and the like, and of appropriate width, thickness and material with regard to the characteristic requirements of the intermediate basis material.

17 Claims, 7 Drawing Sheets

CONNECTOR AND AN ELECTRONIC APPARATUS HAVING ELECTRONIC PARTS CONNECTED TO EACH OTHER BY THE CONNECTOR

BACKGROUND OF THE INVENTION

The present invention relates to connector for electrically connecting electronic part such as a ceramic-made LSI package, for example, to a printed wiring board. In particular, the present invention relates to a connector of a land grid array type in which a terminal of an electronic part and a column of the connector are brought into contact with each other under a certain level of pressure for electrical connection. The present invention further relates to a method of manufacturing such a connector as described. The present invention still further relates to an electronic apparatus in which electric connection is carried out using such a connector as described.

The LSI package as electronic part includes LSI packages of a PGA (Pin grid Array) type, a BGA (Ball grid Array) type, and an LGA (Land grid Array) type. The LSI package of a PGA type is that a plurality of pin-shaped terminals are arranged in a grid-like fashion on the package surface. The LSI package of an LGA type is that a plurality of plane terminals called land is arranged in a grid-like fashion on the package surface. Further, the LSI package of a BGA type is that spherical solder balls are connected to the lands arranged on the package of an LGA type. There are systems described below for connecting these electronic parts to another electronic part such as a board.

As regards the electronic part of a PGA type, respective pin-like terminals of one electronic part are inserted into receptacle provided in the other electronic part to thereby connect the electronic parts. As for the electronic part of a BGA type, the solder balls formed on one electronic part are arranged on respective terminals provided on the other electronic part to mount the one electronic part on the other electronic part. Then, the solder balls are heated to melt, thereby connecting the two electronic parts. For the electronic part of an LGA type, a plate-like connector having electrically conducive members arranged in a grid-like fashion similar to the terminals of electronic part, and an electrically conductive plane film formed of resins containing electrically conductive particles are prepared. Then, such a connector or a film as described is put and arranged on the other electronic part having a plurality of terminals arranged in a grid-like fashion, and further, the one electronic part is arranged on the connector or film. The one electronic part is pressed against the other electronic part through the connector or film, and the one electronic part and the other electronic part are fastened mechanically to each other by means of screws or the like, thereby connecting the two electronic parts electrically. Alternatively, heating is carried out while pressing the one electronic part against the other electronic part to melt a film sandwiched therebetween, thereby connecting the two electronic parts.

The techniques for connecting the electronic part of those types as described above to other electronic part using a connector are disclosed, for example, Japanese Patent Laid-Open NOS. 6-104035, 10-199641, 2001-93635, and 2001-167831.

SUMMARY OF THE INVENTION

The technique in which the electronic part of an LGA type is connected to the other electronic part will be further described with reference to FIG. 7.

FIG. 7 shows a structural view of an electronic apparatus in which terminals 25*a* formed on a first electronic part 710 such as a board and terminals 25*b* formed on a second electronic part 720 such as an LSI package are connected through electrically conductive columns 700. The electrically conductive column 700 is obtained by mixing, for example, metallic fine particles into a resin. The column 700 is embedded into a plurality of holes formed in a thin sheet-like member 730 (for example, a film) and is formed so as to project from both surfaces of the member 730. This column 700 is inserted between the terminal 25*a* of the first electronic part 710 and the terminal 25*b* of the second electronic part 720. More specifically, the column 700 is sandwiched between the terminal 25*a* of the first electronic part 710 and the terminal 25*b* of the second electronic part 720. Then, the second electronic part 720 is pressed against the first electronic part 710 whereby the terminal 25*a* and the terminal 25*b* are strongly pressed against the surface of the column 700. Thus, the terminal 25*a* and the terminal 25*b* are electrically connected to the column 700. In this state, the first electronic part 710 and the second electronic part 720 are fixed to each other mechanically whereby the two electronic parts are connected to each other electrically. The column 700 has spring property, and generates repulsion when the terminal 25*a* and the terminal 25*b* are pressed against each other. Accordingly, a contact pressure of each terminal against the column 700 will reach a value enough to connect the column 700 and each terminal electrically.

However, as shown in FIG. 8, a height of a tip end of the terminal 25*a* or the terminal 25*b* is different from that of other terminals for every electronic part in some cases. In these cases, in the technique shown in FIG. 7, when the terminal 25*a* or the terminal 25*b* is pressed against the associated column 700, the column 700 is deformed heightwise. Thus, the terminals different in height from each other are connected electrically to the respective columns. According to this technique, even if some columns 700 come in contact with the terminals 25*a* and the terminals 25*b*, respectively, for electrical connection, another column 700 may not be still in contact with a corresponding terminal 25*a* or 25*b* due to the unevenness of the height of the terminals. To cause such a column 700 to come into contact with the corresponding terminal 25*a* or 25*b*, it is necessary to press the second electronic part 720 against the first electronic part 710. That is, it is necessary that a load is further applied to the column 700 which is already in contact with the terminal 25*a* and the terminal 25*b* to deform so that all the terminals 25*a* and the terminals 25*b* are connected to the respective columns 700 electrically.

As described above, the column has electrical conductivity and property that tends to be deformed if a load is applied as well as the spring property. However, to accommodate (assimilate) unevenness of height of terminals of the electronic parts and to stabilize the contact resistance produced between the column and the terminal, it is necessary to press the terminal against the column under a pressure of about 30 to 100 g per one terminal. Recently, the number of input/output terminals provided on one electronic part is increasing. Therefore, to connect an electronic part having a number of terminals to the other electronic part by the technique shown in FIG. 7, there is a tendency that an extremely great load has to be applied to the electronic parts. For example, in a case of an electronic part having more than 1000 input/output terminals, to positively connect a group of terminals which are uneven in height to columns, a load over 100 kg has to be applied to the electronic part. When an extremely great load is applied to the electronic part as described above, deformation or breakage of the electronic part possibly occurs. Further, a mechanism of apparatus for applying a great load to a small electronic part becomes complicated as well. These problems result in the cause of increasing the cost of products manufactured by connecting two electronic parts.

Therefore, the present invention is to provide a connector capable of stabilizing a contact resistance produced between each terminal of an electronic part and the connector only by applying a minimum load to the electronic part, and a method of manufacturing the connector. In addition, an electronic apparatus is provided in which a connecter of the present invention is used to electrically connect two electronic parts.

According to the present invention, a connector comprises an intermediate basis material having a spring characteristic, a plurality of first electrically conductive members provided on a first surface of the intermediate basis material, a plurality of second electrically conductive members provided on a second surface of the intermediate basis material, and wiring formed on the intermediate basis material to connect each of the first electrically conductive members to corresponding one of the second electrically conductive members. The connector is inserted between the first electronic part and the second electronic part. When a load is applied between the first electronic part and the second electronic part, the intermediate basis material is deformed due to the spring characteristic, and each of the first electrically conductive members is placed in contact with corresponding one of first terminals. In addition, each of the second electrically conductive members is placed in contact with corresponding one of second terminals. Thus, the connector causes each of the first terminals and corresponding one of the second terminals to be electrically connected to each other.

Further, according to the present invention, an electronic apparatus comprises a first electronic part formed with a plurality of first terminals, a second electronic part formed with a plurality of second terminals, and a connector used for connecting each of the plurality of first terminals to corresponding one of the plurality of second terminals. The connector comprises a sheet-like intermediate basis material having a spring characteristic, a plurality of first electrically conductive members provided on a first surface of the intermediate basis material, a plurality of second electrically conductive members provided on a second surface of the intermediate basis material, and wiring formed on the intermediate basis material to connect each of the first electrically conductive members to any one of the second electrically conductive members. The connector is inserted between the first electronic part and the second electronic part. The intermediate basis material is deformed depending on the load applied to the first electronic part or the second electronic part, whereby each of the first electrically conductive members comes into contact with corresponding one of the first terminals and each of the second electrically conductive members comes into contact with corresponding one of the second terminals. Thus, each of the first terminals is electrically connected to corresponding one of the second terminals.

The connector according to the present invention is able to make the contact resistance produced between each terminal of the electronic part and the connector a sufficiently low value. Further, even if, for example, the number of input/output terminals of the electronic part increases in future, the connector can be utilized for connection of such electronic parts.

DETAILED DESCRIPTION OF THE PREFERRED EMBODIMENTS

A connector and an electronic apparatus (a structural object) in which electronic parts are connected each other using the connector according to one embodiment of the present invention will be specifically described with reference to the drawings.

Figure 1:
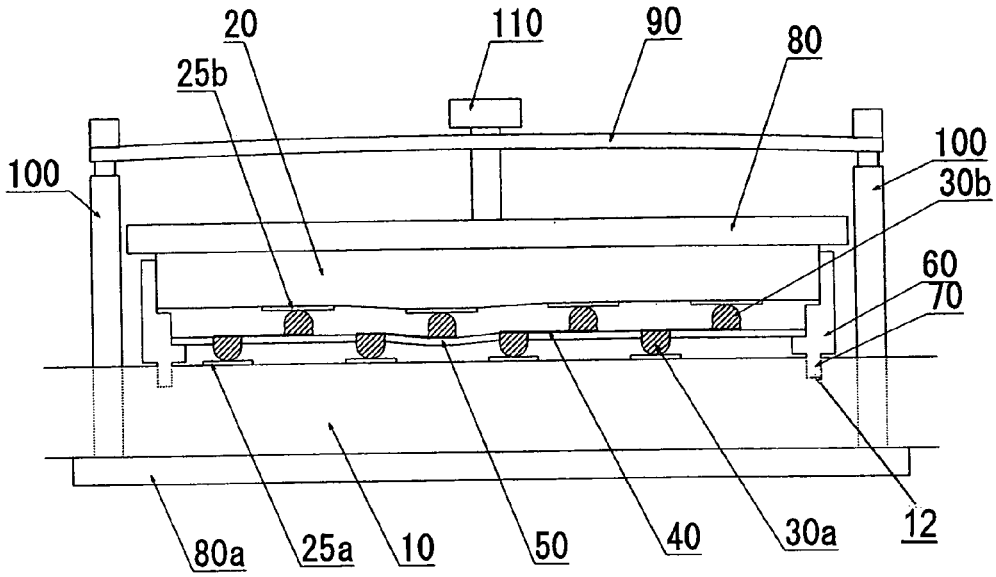
FIG. 1 shows a structural view of an electronic apparatus in which electronic parts are connected to each other using a connector according to one embodiment.

FIG. 1 shows a structural view of an electronic apparatus in which an LSI package (a second electronic part) is connected to a main wiring board (a first electronic part) using a connector according to one embodiment. In FIG. 1, an LSI package (a second electronic part) 20 is mounted on a main wiring board (a first electronic part) 10 using a connector containing a plurality of electrically-conductive members 30*a*, 30*b*. Such members (represented throughout the figures as spherical shapes merely for simplicity) may be columnar, tubular, false columnar or false tubular metallic coupling members. In FIG. 1, the electrically-conductive member are columns 30*a*, 30*b*. The main wiring board 10 is formed with a plurality of terminals 25*a* (a first terminal group), and the LSI package 20 is formed with a plurality of terminals 25*b* (a second terminal group). The connector in the present embodiment is provided with a plurality of columns 30*a* (a first column group) and columns 30*b* (a second column group). The columns 30*a* are arranged at respective positions corresponding to the plurality of terminals 25*a* of the main wiring board 10 and the columns 30*b* are arranged at respective positions corresponding to the plurality of terminals 25*b* of the LSI package 20. Instead of column 30*a* and column 30*b*, the coupling members can take the form of, for example, a metallic ball (e.g., see FIG. 3(*g*)), such as Au-Sn, etc., which is lead-free. The surfaces of the column 30*a* and column 30*b* are formed with inoxidizable gold-plating. The surfaces of the terminals 25*a* and 25*b* of the main wiring board 10 and the LSI package 20, respectively, are also formed with inoxidizable gold-plating. The column 30*a* and column 30*b* are supported by an intermediate basis material 50 formed of a material such as polyimide. As shown in FIG. 1, the plurality of columns 30*a* are formed on the surface of the intermediate basis material 50 confronting the main wiring board 10. The plurality of columns 30*a* are arranged at respective positions substantially corresponding to the terminals 25*a* of the main wiring board 10. Further, the plurality of columns 30*b* are formed on the surface of the intermediate basis material 50 confronting the LSI package 20. The plurality of columns 30*b* are arranged at respective positions substantially corresponding to the terminals 25*b* of the LSI package 20. Each terminal 25*a* is connected to one associated (predetermined) terminal 25*b* in the plurality of terminals 25*b*. Therefore, a pair of columns 30*a* and column 30*b*, which are to be connected to the terminal 25*a* and terminal 25*b*, respectively, to be connected. are connected by wiring 40. The wiring 40 is formed of metal such as copper, etc. The wiring 40 is provided on the intermediate basis material 50. For the intermediate basis material 50, a desired material is selected for use in consideration of mechanical characteristics, such as Young's modulus, tensile elongation characteristic, stress relief property or the like. Also, for the column 30*a*, the column 30*b* and the wiring 40, material, width and thickness are designed in consideration of the mechanical characteristics of the intermediate basis material 50.

Figure 9:
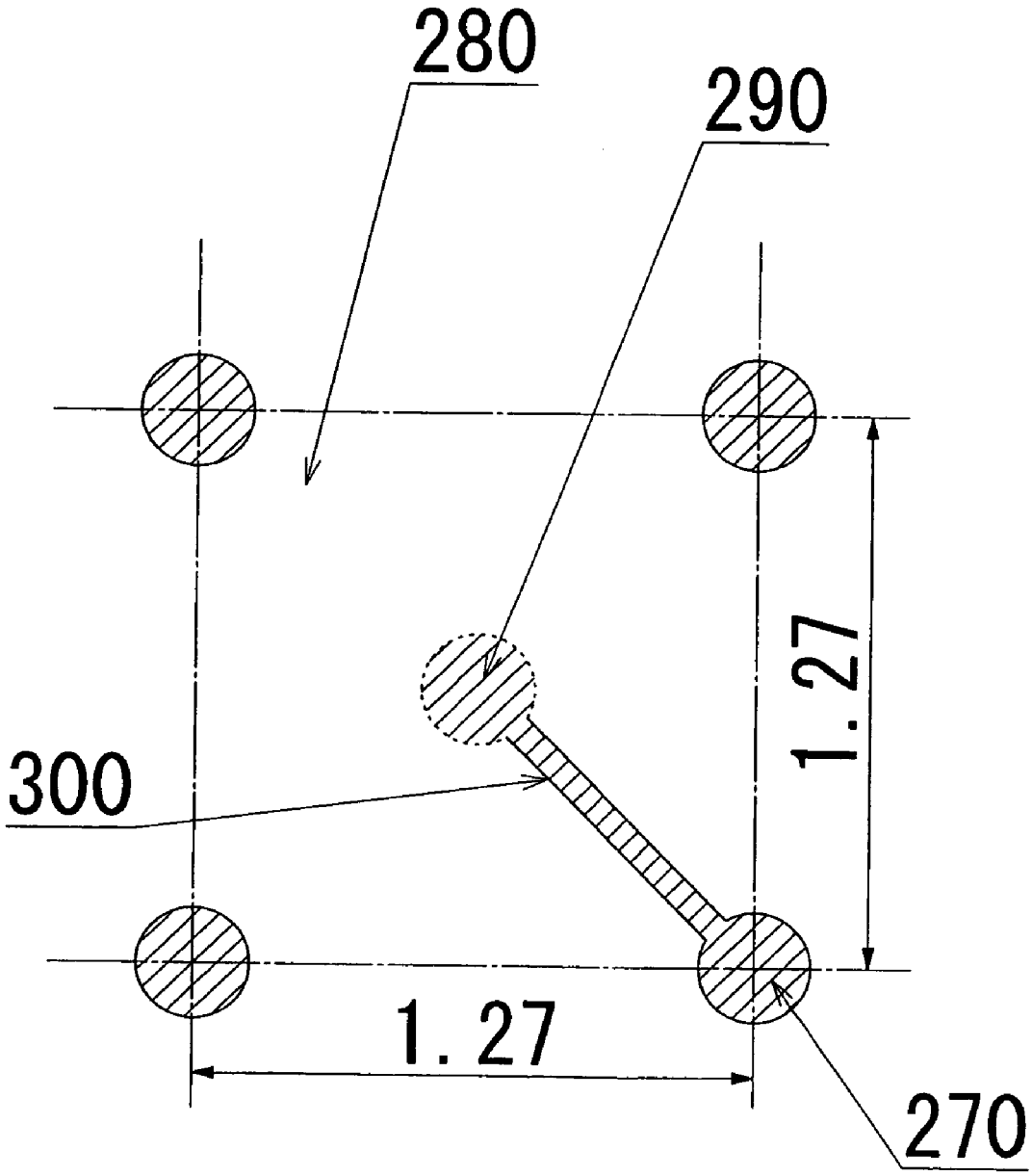
FIG. 9 shows an arrangement of a pattern of a connector.

The spring characteristic required for the connector in the present embodiment will be mentioned specifically using, for example, FIG. 9. FIG. 9 shows an arrangement of a pattern on one surface of the connector connected to the LSI package. Each terminal 270 on which the column 30*b* is mounted has a diameter of approximately 0.18 mm. Each terminal 270 is formed on one surface of a polyimide intermediate basis material (corresponding to the intermediate basis material 50 shown in FIG. 1). These terminals 270 are arranged at the points of intersection of square grids having a pitch (spacing) of approximately 1.2 mm. A terminal 290 on which the column 30*a* is mounted is formed at a position corresponding to each center part of the square grid. Between the terminal 270 and the terminal 290 to be connected thereto is copper wiring 300 (corresponding to the wiring 40 shown in FIG. 1) having a width of approximately 25 μm, and a through hole formed in the polyimide intermediate basis material 280. Metal plating (not shown) is embedded in the through hole.

Figure 10:
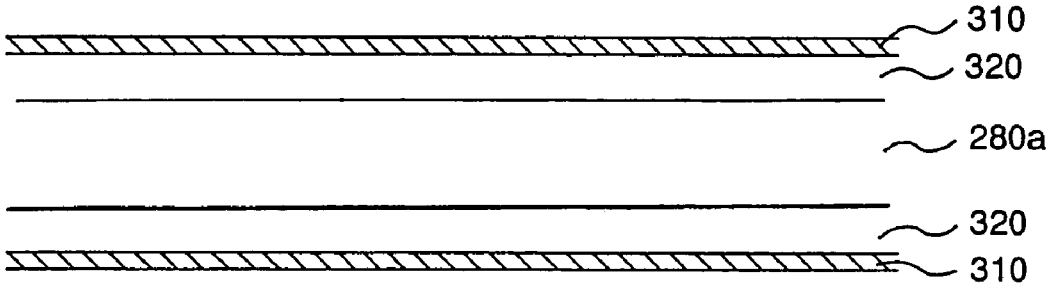
FIG. 10 shows a structural view of a polyimide intermediate basis material.
Figure 11:
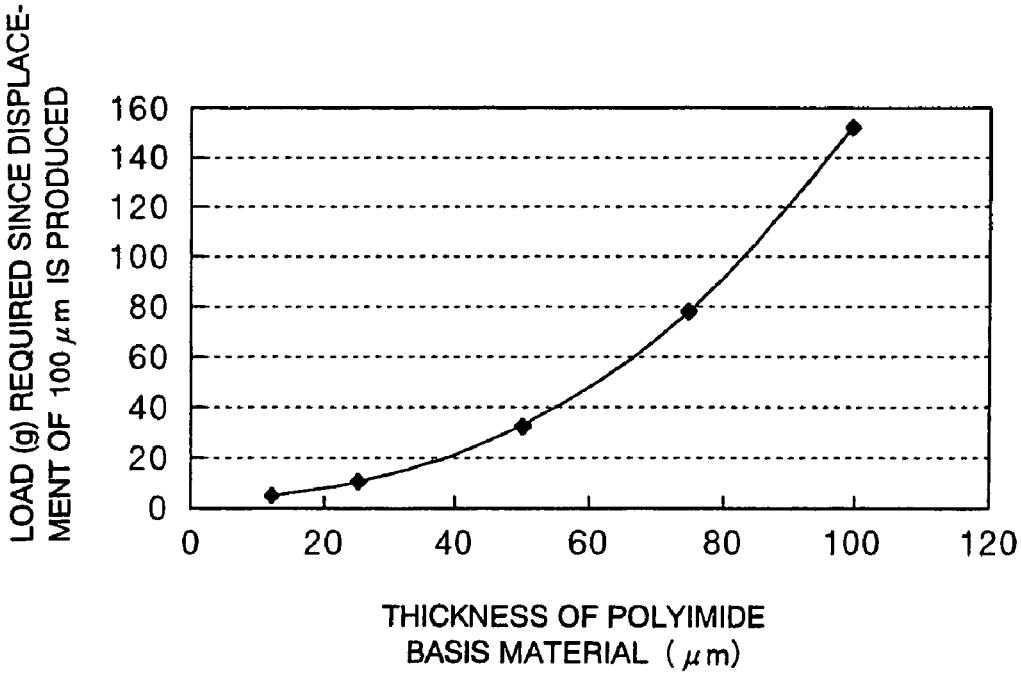
FIG. 11 shows a graph showing a relationship between a load required to displace a column mounted on a polyimide basis material 280*a* by 100 $\mu$m height-wise and a thickness of the polyimide basis material.

FIG. 10 shows a structural view of the polyimide intermediate basis material 280. The intermediate basis material 280 consists of a polyimide basis material 280*a* serving as a main material, copper foils 310 and adhesive layers 320. The thickness of the polyimide basis material 280*a* is approximately 25 μm. To both surfaces of the polyimide basis material 280*a* are connected the copper foils 310 each having a thickness of approximately 3 μm by way of the adhesive layer 320 having a thickness of approximately 10 μm. The spring characteristic of the polyimide intermediate basis material 280 is exhibited mainly with help of properties of the polyimide basis material 280*a* depending on the mechanical characteristics of the adhesive layer 320 and the copper wiring 300. FIG. 11 shows a graph showing a relationship between a load (g) necessary for displacing a column to be mounted on the polyimide basis material 280*a* by 100 μm height-wise and a thickness (μm) of the polyimide basis material. It is understood from the graph of FIG. 11 that for example, if the thickness of the polyimide basis material is 25 μm, the polyimide basis material has the spring characteristic enough to displace the column by 100 μm by an impression load of 10 gf. Thus, even if the column is a rigid body having no spring characteristic, the polyimide intermediate basis material 280 is able to accommodate the unevenness in height of a group of terminals formed on an electronic part, thereby causing the terminals of the electronic part to be in contact with the column under the desired pressure.

Accordingly, a metal having no spring property can be also used for the column 30*a* or 30*b*. That is, a material for the column 30*a* or 30*b* can be selected without taking the spring property into consideration. Thus, the electric characteristic of the column 30*a* or the column 30*b* and the spring characteristic of the intermediate basis material 50 can be designed separately.

Returning to FIG. 1, the intermediate basis material 50 of the connector is held by frame 60*s* formed of a plastic or the like. The intermediate basis material 50 may be secured to the frame 60 in advance, or may be merely supported by the frame 60. The frame 60 is provided with a pin 70 for arranging the frame 60 on the main wiring board 10 accurately. The main wiring board 10 is formed with a hole 12 into which the pin 70 is inserted. The pin 70 is inserted into the hole 12 whereby the frame 60 is accurately secured to the main wiring board 10. Thus, the terminals 25*a* formed on the main wiring board 10 and the columns 30*a* formed on the intermediate basis material 50 held on the frame 60 are positioned horizontally. It is noted that a mechanism for securing the frame 60 to the main wiring board 10 is not limited to the mechanism using the pin 70 and the hole 12. Whatever mechanism may be will suffice as long as the terminals 25*a* and the columns 30*a* can be positioned horizontally.

Further, the frame 60 is also provided with a mechanism for accurately arranging and securing the LSI package 20 to the connector. With this mechanism, the columns 30*b* formed on the intermediate basis material 50 and the terminals 25*b* of the LSI package 20 are positioned horizontally.

Next, the method of using the connector in the present embodiment will be described hereinafter.

First, the pin 70 of the frame 60 is inserted into the hole 12, and the frame 60 is secured to the main wiring board 10. Where the intermediate basis material 50 is secured to the frame 60, the frame 60 is secured to the main wiring board 10 whereby the columns 30*a* are arranged and mounted on the respective terminals 25 of the main wiring board 10. Next, the LSI package 20 is fitted into the frame 60, and the LSI package 20 is held by the mechanism provided in the frame 60. Thus, the terminals 25*b* of the LSI package 20 are arranged and mounted on the respective columns 30*b*. Then, the fixed load (pressure) is applied to the LSI package 20 to press it against the main wiring board 10 through the connector. In this case, support plates 80*a* and 80*b* for supporting the main wiring board 10 and the LSI package 20, respectively, are prepared so that a load will not partly applied to the main wiring board 10 and the LSI package 20 to prevent them from being partly deformed. In FIG. 1, the support plate 80*a* (a first support plate) is arranged on the lower surface of the main wiring board 10. On the other hand, the support plate 80*b* (a second support plate) is arranged on the upper surface of the LSI package 20 and the load is applied through the support plate 80. To apply the load to the LSI package 20, a load mechanism is used. The load mechanism comprises a support column 100 secured to the support plate 80*a*, a plate spring 90 supported on the support column, and a screw 110 extending though the plate spring 90. With this load mechanism, the screw 110 is rotated in the tightening direction to thereby deform the plate spring 90. This produces repulsive force of the plate spring 90 so that a fixed load is applied between the main wiring board 10 and the LSI package 20, which condition is maintained by the load mechanism. It is noted that the support column 100 secured to the support plate 80*a* has a diameter enough to prevent deformation caused by the load. The application of the load causes the terminals 25*b* of the LSI package 20 to come into contact with the columns 30*b* of the connector under the desired pressure, and the terminals 25*a* of the main wiring board 10 to come into contact with the columns 30*a* under the desired pressure. It is noted that a mechanism for applying a load is not limited to the load mechanism shown in FIG. 1. Any load mechanism may be used as long as it produces the fixed load between the support plate 80*a* and the support plate 80*b*.

Figure 2:
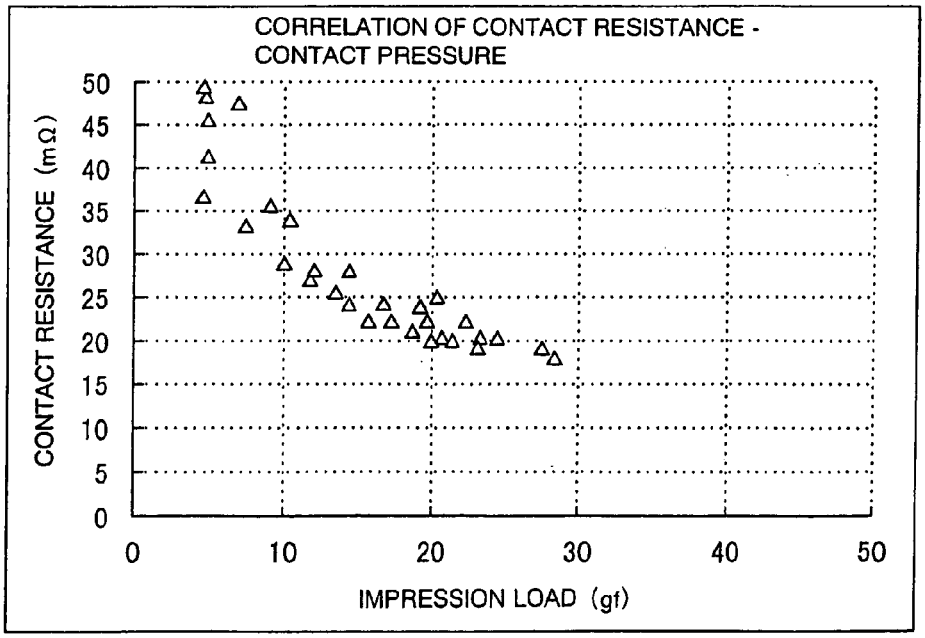
FIG. 2 shows a graph showing a relationship between contact pressure and contact resistance between a column and a terminal.

FIG. 2 is a graph showing a correlation of contact resistance with contact pressure between the column 30*a* and the terminal 25*a* and between the column 30*b* and the terminal 25*b*. As mentioned above, each column is formed of Au—Sn alloy, on the surface of which is applied with gold-plating. On the other hand, gold-plating is also applied to the surface of each terminal. Where gold comes into contact with another gold as above, when a load of approximately 20 gf is applied (that is, contact pressure is approximately 20 gf), as shown in FIG. 2, the contact resistance is less than approximately 25 mΩ. Accordingly, with application of a load of approximately 20 gram per contact surface between each column and each terminal, the contact resistance therebetween will be a sufficiently low value.

Further, as described above, if material or dimensions of the intermediate basis material 50 are suitably selected, the intermediate basis material can be provided with the spring characteristic in which it is displaced about 100 μm by a load of approximately 10 gram. Therefore, for example, where a height of the terminal 25*a* or terminal 25*b* is different from those of other terminals by approximately 100 μm, if a load of approximately 30 gram per one terminal is applied, a load of not less than approximately 20 gram can be applied to all the terminals. Consequently, the contact resistance between the column and the terminal will be a stabilized value of not more than approximately 25 mΩ. For example, where the LSI package 20 is provided with approximately 1000 terminals, the total load applied to the LSI package is needed only to be about 30 kg. This value of the load is a far low value as compared with the load applied to the electronic parts in the technique shown in FIGS. 7 and 8.

Where the connector in the present embodiment is used, the column 30*a* and the column 30*b* are merely in contact with the terminal 25*a* and the terminal 25*b*, respectively. Accordingly, for example, where the LSI package 20 is removed from the main wiring board 10, it is only necessary that the load mechanism is disengaged from the electronic apparatus and the LSI package 20 is removed from the frame 60. Further, also where the connector itself is removed from the main wiring board 10, it is only necessary that the frame 60 is removed from the main wiring board 10. As described, when the connector in the present embodiment is used, the electronic parts can be exchanged easily.

Figure 7:
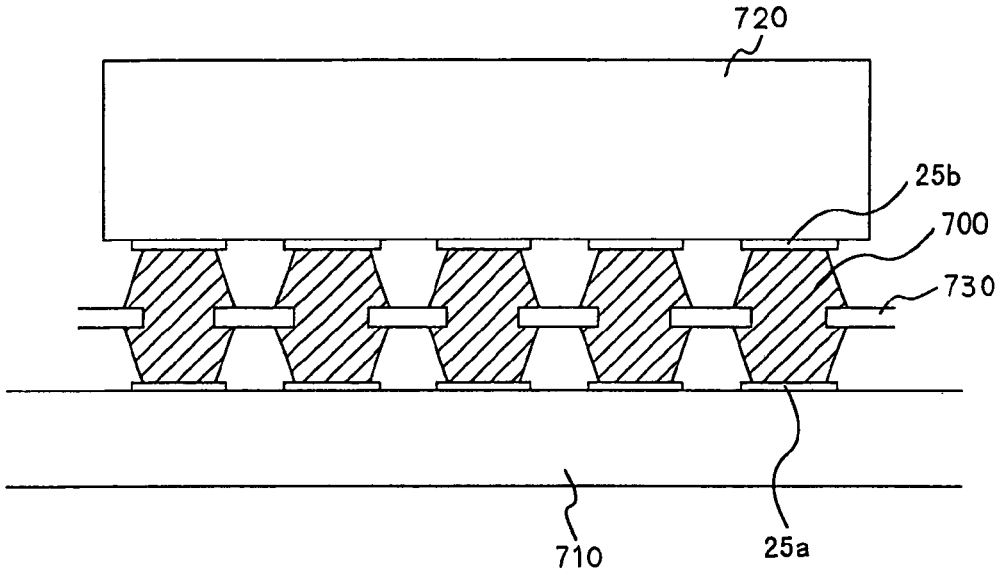
FIG. 7 shows a structural view of an electronic apparatus in which electronic parts are connected to each other through an electrically conductive column.
Figure 8:
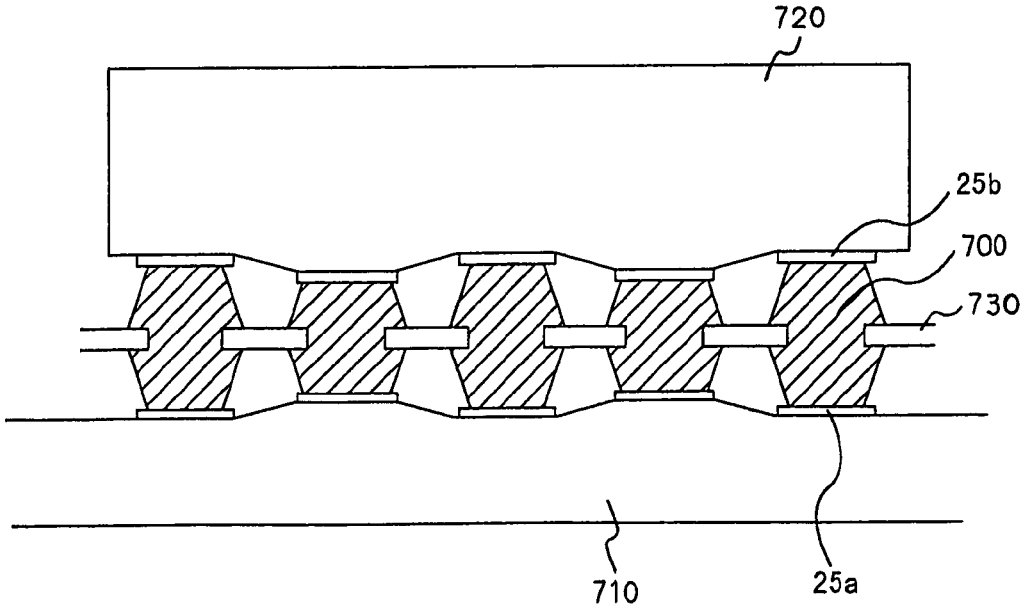
FIG. 8 shows a structural view of an electronic apparatus in which electronic parts are connected to each other through an electrically conductive column in a case where heights of terminals are different from that of other terminals for every electronic part.

Furthers when the connector in the present embodiment is used, the contact resistance between the column and the terminal will be a sufficiently low value by merely applying less load as compared with the connectors shown in FIGS. 7 and 8. Accordingly, the connector of the present invention is applicable to the electronic parts for which the connectors shown in FIGS. 7 and 8 could not be used due to the short of mechanical strength.

Next, the steps of manufacturing a connector will be described in detail with reference to FIG. 3.

Figure 3:
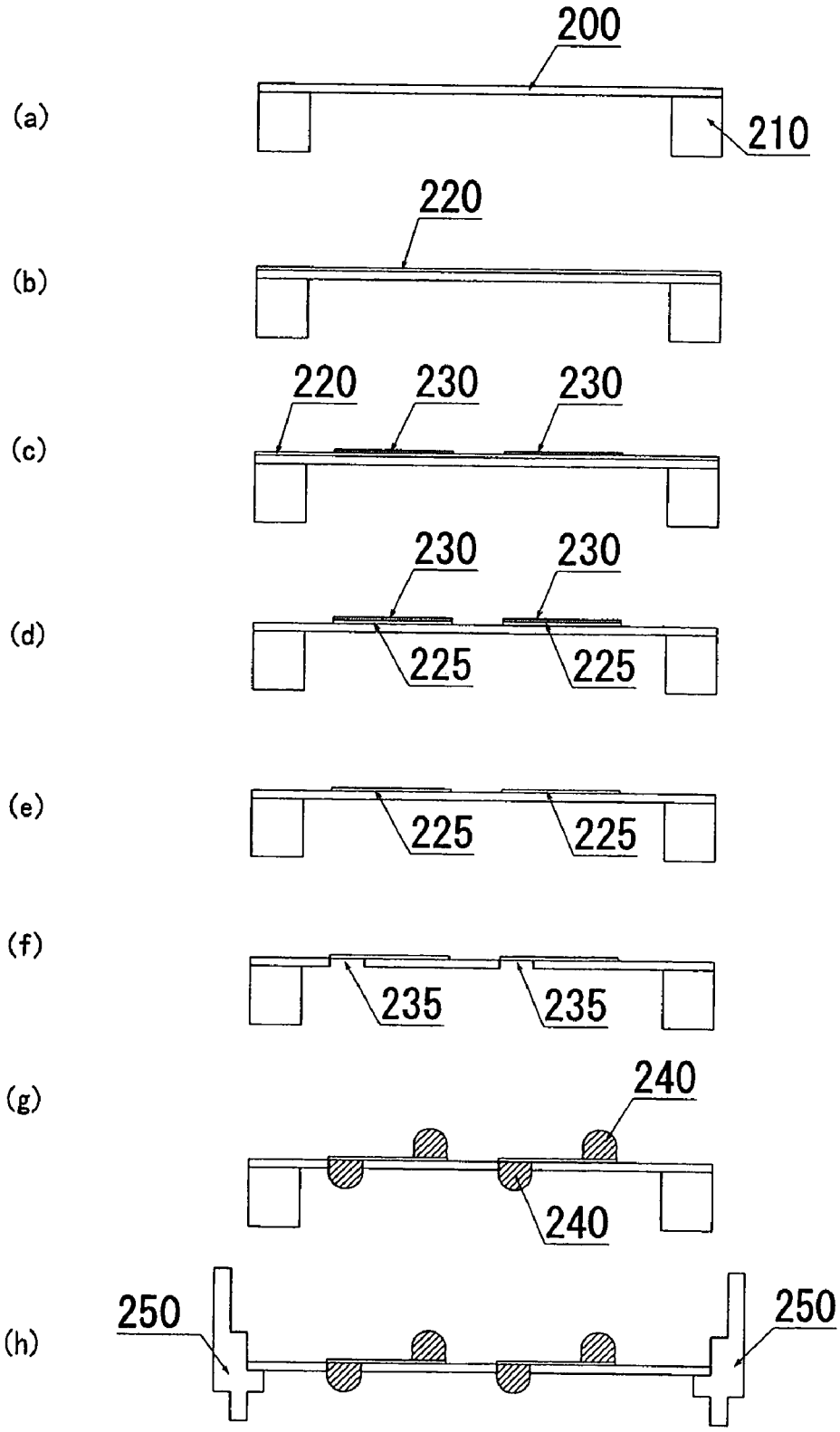
FIG. 3 shows the steps of manufacturing a connector.

First, as shown in FIG. 3(*a*), a commercially available polyimide film 200 having a thickness of approximately 50 μm is pasted to a frame 210. This facilitates handling of the polyimide film 200 in the manufacturing steps. Next, as shown in FIG. 3(*b*), a copper film 220 having a thickness of approximately 5 μm is formed on one surface of the polyimide film 200 by sputtering. Then, a photo-resist film is formed on the copper film 220 by spin coating. In addition, a desired position of the photo-resist film is exposed to light and developed. As shown in FIG. 3(*c*), this forms a photo-resist pattern 230 on the copper film 220. By the step shown in FIG. 3(*c*), a desired shaped photo-resist pattern 230 is formed at a desired position. Next, the copper membrane 220 is subjected to etching in accordance with the photo-resist pattern 230, whereby a copper pattern 225 having a width of approximately 50 μm is formed, as shown in FIG. 3(*d*). The copper pattern 225 corresponds to the wiring 40 shown in FIG. 1. As will be described later, columns are formed at desired positions of the copper pattern 225. After the copper pattern 225 is formed, a photo-resist pattern 230 is removed as shown in FIG. 3(*e*). Next, out of the other surface of the polyimide film 200, a portion of the polyimide film 200 corresponding to a position 235 at which a column is mounted is removed as shown in FIG. 3(*f*). In this step, for example, a laser beam is incident on the column mounting position 235 of the polyimide film 200 to erase the polyimide film 200 at that position. Next, metal balls 240*a* and metal balls 240*b* are mounted at desired positions of each surface of the polyimide film 200. The metal balls 240*b* are mounted on the copper pattern 225. The metal balls 240*a* are arranged at the respective portions from which the corresponding portions of the polyimide film 200 were removed so as to come in contact with the copper pattern 225. The metal balls 240*a* and 240*b* are formed of Au-Sn alloy or the like which is lead-free. As shown in FIG. 3(*g*), the metal ball 240*a* and the metal ball 240*b* are connected to the copper pattern 225 by reflow. The metal ball 240*a* and the metal ball 240*b* correspond to the column 30*a* and the column 30*b*, respectively, shown in FIG. 1. Next, nickel-plating is applied to the surfaces of the copper pattern 225 and the metal balls 240*a* and 240*b*. Further, gold-plating is applied to the surfaces of the copper pattern 225, the metal ball 240*a* and the metal ball 240*b*, to which nickel-plating was applied. Thus, gold-plating is applied to the surfaces of the copper pattern 225 and the metal balls 240*a* and 240*b*.

Next, the polyimide film 200 is cut into the desired size, and is cut away from the frame 21. Further, a frame 250 is prepared which is provided with locating pins 70 and a mechanism for holding the LSI package. The frame 250 is formed of plastics or the like. The frame 250 corresponds to the frame 60 shown in FIG. 1. As shown in FIG. 3(*h*), the cut polyimide film 200 is secured to the frame 250. The polyimide film 200 is secured to the frame 250, for example, by an adhesive. Thus, the connector shown in FIG. 1 is completed.

Figure 4:
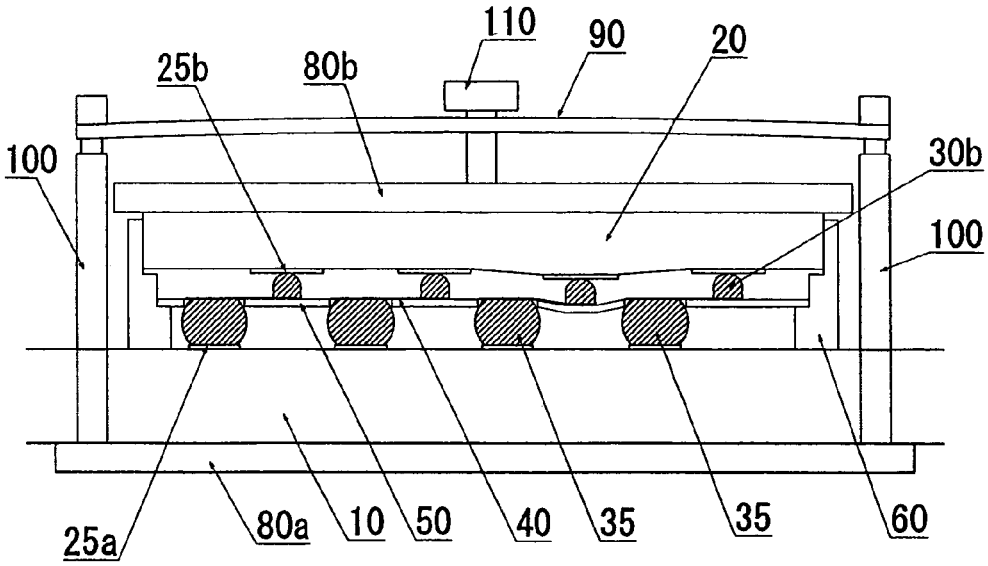
FIG. 4 shows a structural view of another electronic apparatus in which electronic parts are connected to each other using a connector.

In the connector shown in FIG. 1, the plurality of columns 30*a* and 30*b* are formed on the respective surfaces of the intermediate basis material 50. However, solder balls may be used in place of these columns 30*a* or 30*b*. FIG. 4 shows a structure view of an electronic apparatus in which the LSI package 20 is connected to the main wiring board 10 using a connector for which solder balls 35 are used in place of the columns 30*a*. The connector shown in FIG. 4 is different from the connector shown in FIG. 1 in that the solder balls 35 are used in place of the columns 30*a* as mentioned above. The terminals 25*a* of the main wiring board 10 are connected to the plurality of respective solder balls 35 provided on the connector. Specifically, the plurality of solder balls 35 are arranged on the surface of the intermediate basis material 50 facing the main wiring board 10. Each solder ball 35 is in contact with each associated terminal 25*a* of the main wiring board 10. When in this state, the solder ball 35 is heated, the solder ball 35 becomes melted and is connected to the associated terminal 25*a*. Naturally, the solder ball 35 may be used in place of the column 30*b* instead of the column 30*a* and connected to the associated terminal 25*b* of the LSI package 20. Except the foregoing, the structure of the electronic apparatus shown in FIG. 4 is the same as that of the electronic apparatus shown in FIG. 1.

Next, the method of using the aforementioned connector will be described with reference to FIG. 4. The frame 60 is secured to the main wiring board 10, similarly to that described with reference to FIG. 1. Since the intermediate basis material 50 is secured to the frame 60, the solder balls 35 are arranged and mounted on the respective terminals 25*a* of the main wiring board 10 by securing the frame 60 to the main wiring board 10. In the state in which the connector is mounted on the main wiring board 10, the whole body (object) is heated using a reflow furnace or the like. Accordingly, the solder balls 35 are molten and connected to the terminals 25*a*. Thereafter, the LSI package 20 is held on the frame 60. Thus, the terminals 25*b* of the LSI package 20 are arranged and mounted on the columns 30*b*. Next, the support plates 80*a*, 80*b* for supporting the main wiring board 10 and the LSI package 20 respectively are arranged. A predetermined load (pressure) is applied to the LSI package 20 and the main wiring board 10 using the same load mechanism as that shown in FIG. 1. As a result, the terminals 25*b* of the LSI package 20 come into contact with the columns 30*b* of the connector under the desired pressure.

Figure 5:
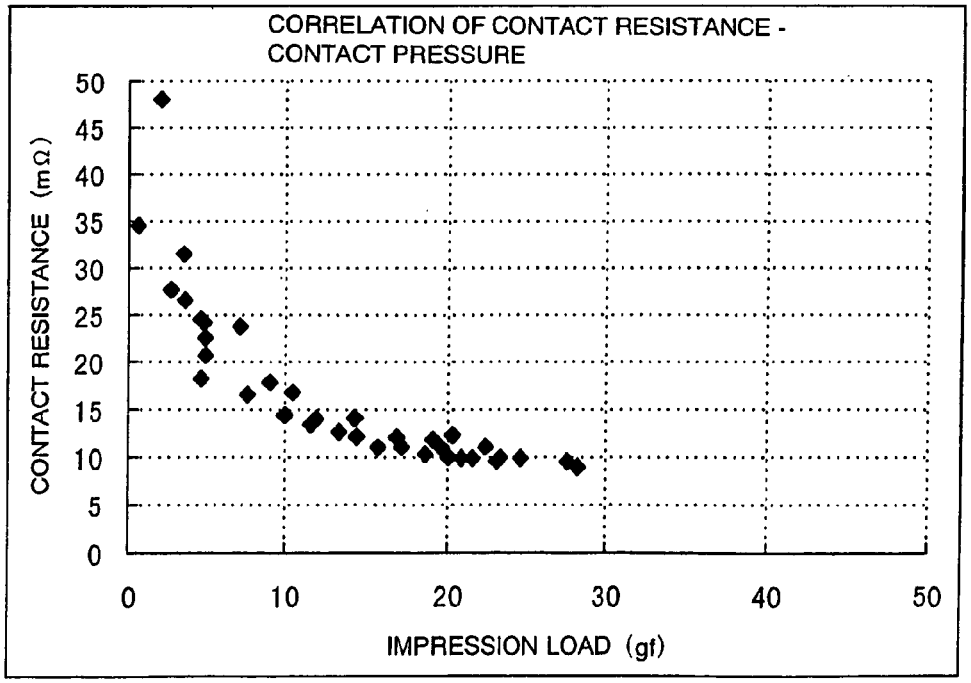
FIG. 5 shows a graph showing a relationship between contact pressure and contact resistance between a column and a terminal.

FIG. 5 is a graph showing a correlation of contact resistance with contact pressure between the column 30*b* and the terminal 25*b* in the electronic apparatus shown in FIG. 4. As shown in FIG. 5, when a load of approximately 20 gf is applied, the contact resistance will be not more than approximately 15 mΩ. As described, the value of the contact resistance with respect to the contact pressure shown in FIG. 5 further lowers than that shown in FIG. 2. This is because of the fact that the solder balls 35 of the connector are adhered to the terminals 25*a* of the main wiring board 10. Thus, since it is only necessary that the columns 30*b* of the connector come into contact with the respective terminals 25*b* of the LSI package 20, the contact load as well as the contact resistance will be a low value.

For example, where the height of the terminals 25*b* have unevenness of approximately 100 μm, if a load of approximately 20 gram per terminal is applied, a load of not less than approximately 10 gram can be applied to each terminal. Accordingly, the contact resistance between the column 30*b* and the terminal 25*b* will be a stabilized value not more than approximately 20 mΩ. For example, where the LSI package 20 is provided with approximately 1000 terminals, it is only necessary that the total load applied to the LSI package is approximately 20 kg.

Next, the method of manufacturing a connector shown in FIG. 4 will be described in detail with reference to FIG. 6.

Figure 6:
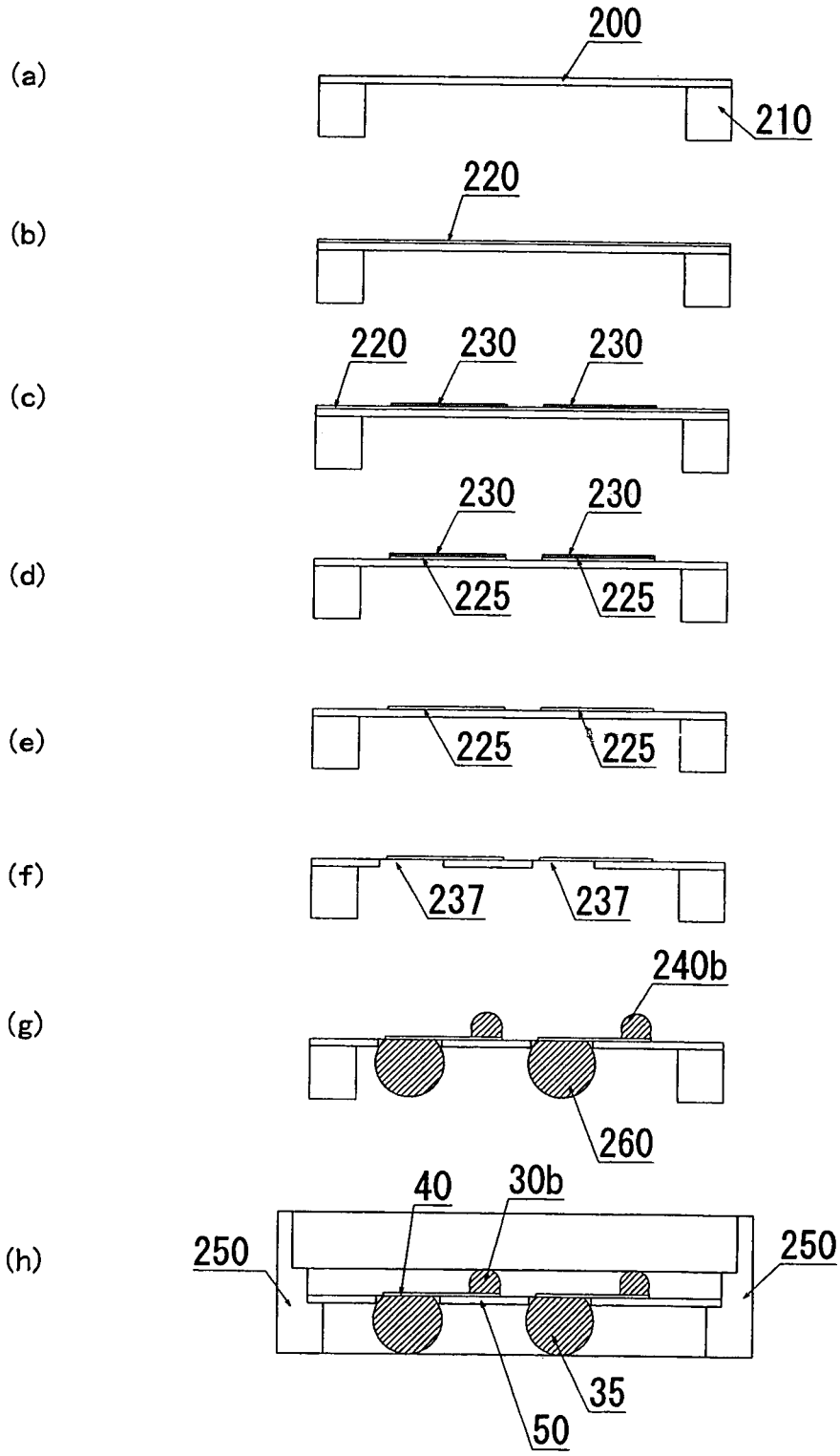
FIG. 6 shows the steps of manufacturing a connector.

The steps shown in FIGS. 6(*a*) to 6(*e*) are the same as those shown in FIGS. 3(*a*) to 3(*e*). Next, as shown in FIG. 6(*f*), on the surfaces connected to the main wiring board 10 of the polyimide film 200, a portion of the polyimide film 200 corresponding to a position 237 at which the solder ball 35 is mounted is removed. In this step, for example, a laser beam is incident on a column mounting position 235 of the polyimide film 200 to erase the polyimide film 200 at that position. Next, a plurality of metal balls 240*b* are mounted at desired positions of the surface connected to the LSI package 20 of the connector. The metal balls 240*b* are mounted on the copper pattern 225. The metal balls 240*b* are formed of Au—Sn alloy or the like which is lead-free. On the other hand, a plurality of solder balls 260 are arranged at the respective portions from which the corresponding portions of the polyimide film 200 is removed on the surface connected to the main wiring board 10 of the connector. Each solder ball 260 comes into contact with the copper pattern 225. The solder ball 260 is formed of lead-free solder comprising, for example, a component ratio between approximately 97% of tin and approximately 3% of copper. As shown in FIG. 6(*g*), the metal balls 240*b* and the solder balls 35 are connected to the copper pattern 225 by reflow. The metal balls 240 correspond to the columns 30*b* shown in FIG. 4. Further, the solder balls 260 correspond to the solder balls 35 shown in FIG. 4. Next, nickel plating is applied to the copper pattern 225 and the surfaces of the metal balls 240*b*. Further, gold-plating is applied to the copper pattern 225 and the surfaces of the metal balls 240*b*. Thus, gold-plating is formed on the copper pattern 225 and the surfaces of the metal balls 240*b*. The succeeding step shown in FIG. 6(*h*) is the same as that shown in FIG. 3(*h*).

In the aforementioned manufacturing method, the solder balls 260 are connected to the connector. However, the solder balls 260 may be mounted on the respective terminals 25*a* of the main wiring board 10. In this case, when the connector is secured to the main wiring board 10, the solder balls 260 are arranged on the respective portions from which the corresponding portions of the polyimide film 200 are removed. Then, the solder balls 260 are heated and molten whereby the solder balls 260 are connected to the terminals 25*a* and the copper pattern 225.

What is claimed is:

1. A connector used for connecting a plurality of first terminals formed on a first electronic part to a plurality of respective second terminals formed on a second electronic part said connector comprising:

a substantially-rigid sheet-like intermediate basis material having a spring characteristic;

a plurality of first electrically conductive members provided on a first surface of said intermediate basis material, ones of said first electrically conductive members being respectively arranged at positions substantially corresponding to ones of said first terminals:

a plurality of second electrically conductive members provided on a second surface of said intermediate basis material the second surface being the opposite surface of the first surface, ones of said second electrically conductive members being respectively arranged at positions substantially corresponding to ones of said second terminals; and wiring formed on said intermediate basis material to respectively connect ones of said first electrically conductive members to ones of said second electrically conductive members, wherein, when said connector is inserted between said first electronic part and said second electronic part and a load is applied to bias said first electronic part and said second electronic part toward each other, said intermediate basis material is deformed due to said spring characteristic, whereby ones of said first electrically conductive members are placed in contact with corresponding ones of said first terminals and ones of said second electrically conductive members are placed in contact with corresponding ones of said second terminals, such that ones of said first terminals are electrically connected to corresponding ones of said second terminals; and a frame portion secured to said first electronic part or said second electronic part, to support said intermediate basis material at a predetermined position.

2. A connector used for connecting a plurality of first terminals formed on a first electronic part to a plurality of respective second terminals formed on a second electronic part, said connector comprising:

a substantially-rigid sheet-like intermediate basis material having a spring characteristic;

a plurality of first electrically conductive members provided on a first surface of said intermediate basis material, ones of said first electrically conductive members being respectively arranged at positions substantially corresponding to that of ones of said first terminals;

a plurality of second electrically conductive members provided on a second surface of said intermediate basis material, said second surface is the opposite surface of said first surface, ones of said second electrically conductive members being respectively arranged at positions substantially corresponding to that of ones of said second terminals; and wiring formed on said intermediate basis material to respectively connect ones of said first electrically conductive members to ones of said second electrically conductive members;

wherein ones of said first electrically conductive members are connected to corresponding ones of said first terminals, whereby said connector is secured to said first electronic part, and when said second electronic part is pressed towards said first electronic part through said connector, said intermediate basis material is deformed due to said spring characteristic so that ones of said second electrically conductive members are placed in contact with respective corresponding ones of said second terminals, and ones of said first terminals are electrically connected to corresponding ones of said second terminals.

3. The connector according to claim 2, wherein each of said first electrically conductive members is a solder ball.

4. The connector according to claim 2, wherein a thickness of the intermediate basis material is thinner than a thickness of the first and second terminals.

5. The connector according to claim 2, wherein a first electrically conductive member on said first surface is provided in a substantially center position between four adjoined ones of said second electrically conductive members on said second surface; and/or a second electrically conductive member on said second surface is provided in a substantially center position between four adjoined ones of said first electrically conductive members on said first surface.

6. The connector according to claim 2 wherein ones of the first electrically conductive members and ones of the second electrically conductive members, are offset with respect to one another, such that at least a majority of the first electrically conductive members and the second electrically conductive members do not lie on a same perpendicular axis drawn through a major plane of the intermediate basis material.

7. An electronic apparatus, comprising:

a first electronic part formed with a plurality of first terminals;

a second electronic part formed with a plurality of second terminals; and a connector used for connecting said plurality of first terminals to said plurality of respective second terminals, said connector comprising:

a substantially rigid sheet-like intermediate basis material having a spring characteristic;

a plurality of first electrically conductive members provided on a first surface of said intermediate basis material, ones of said first electrically conductive members being arranged at positions substantially corresponding to that of ones of said first terminals;

a plurality of second electrically conductive members provided on a second surface of said intermediate basis material, said second surface being the opposite surface of said first surface, ones of said second electrically conductive members being arranged at positions substantially corresponding to that of ones of said second terminals; and wiring formed on said intermediate basis material to respectively connect ones of said first electrically conductive members to ones of said second electrically conductive members, wherein said connector is inserted between said first electronic part and said second electronic part, said intermediate basis material planarly-deflects at localized areas according to a load applied to bias said first electronic part or said second electronic part, whereby ones of said first electrically conductive members comes in contact with corresponding ones of said first terminals and ones of said second electrically conductive members comes in contact with corresponding ones of said second terminals, and ones of said first terminals are electrically connected to corresponding ones of said second terminals.

8. The electronic apparatus according to claim 7, wherein each of said first electrically conductive members or each of said second electrically conductive members of said connector is columnar or tubular metal.

9. The connector according to claim 8, wherein each of said first electrically conductive members or each of said second electrically conductive members is formed of an alloy comprising gold and tin.

10. The connector according to claim 7, wherein said intermediate basis material is formed of a polyimide.

11. The connector according to claim 7, wherein said intermediate basis material is deformed by about 100 $\mu$m in a vertical direction due to said spring characteristic when a load of 10 gf is applied to said intermediate basis material.

12. The apparatus according to claim 7, wherein a thickness of the intermediate basis material is thinner than a thickness of the first and second terminals.

13. The apparatus according to claim 7, wherein a first electrically conductive member on said first surface is provided in a substantially center position between four adjoined ones of said second electrically conductive members on said second surface; and/or a second electrically conductive member on said second surface is provided in a substantially center position between four adjoined ones of said first electrically conductive members on said first surface.

14. The apparatus according to claim 7, wherein ones of the first electrically conductive members and ones of the second electrically conductive members, are offset with respect to one another, such that at least a majority of the first electrically conductive members and the second electrically conductive members do not lie on a same perpendicular axis drawn through a major plane of the intermediate basis material.

15. An electronic apparatus, comprising:

a first electronic part formed with a plurality of first terminals;

a second electronic part formed with a plurality of second terminals; and a connector used for connecting said plurality of first terminals to said plurality of respective second terminals, said connector comprising:

a substantially rigid sheet-like intermediate basis material having a spring characteristic;

a plurality of first electrically conductive members provided on a first surface of said intermediate basis material, ones of said first electrically conductive members being arranged at positions substantially corresponding to that of ones of said first terminals:

a plurality of second electrically conductive members provided on a second surface of said intermediate basis material, said second surface being the opposite surface of said first surface, ones of said second electrically conductive members being arranged at positions substantially corresponding to that of ones of said second terminals; and wiring formed on said intermediate basis material to respectively connect ones of said first electrically conductive members to ones of said second electrically conductive members, wherein said connector is inserted between said first electronic part and said second electronic part, said intermediate basis material planarly-deflects at localized areas according to a load applied to bias said first electronic part or said second electronic part, whereby ones of said first electrically conductive members comes in contact with corresponding ones of said first terminals and ones of said second electrically conductive members comes in contact with corresponding ones of said second terminals, and ones of said first terminals are electrically connected to corresponding ones of said second terminals; and, a mechanism for applying a load to bias said first electronic part or said second electronic part, said mechanism biasing said first electronic part against said second electronic part or vice versa through said connector.

16. The electronic apparatus according to claim 15, wherein said mechanism includes:

a first support portion for supporting said first electronic part from a surface opposite with the surface formed with said plurality of first terminals;

a second support portion for supporting said second electronic part from a surface opposite with the surface formed with said plurality of second terminals; and a pressing portion for pressing said second support portion in a direction towards said first support portion from said second support portion.

17. An electronic apparatus, comprising:

a first electronic part formed with a plurality of first terminals;

a second electronic part formed with a plurality of second terminals; and a connector used for connecting said plurality of first terminals to said plurality of respective second terminals, said connector comprising:

a substantially rigid sheet-like intermediate basis material having a spring characteristic;

a plurality of first electrically conductive members provided on a first surface of said intermediate basis material, ones of said first electrically conductive members being arranged at positions substantially corresponding to that of ones of said first terminals;

a plurality of second electrically conductive members provided on a second surface of said intermediate basis material, said second surface being the opposite surface of said first surface, ones of said second electrically conductive members being arranged at positions substantially corresponding to that of ones of said second terminals; and wiring formed on said intermediate basis material to respectively connect ones of said first electrically conductive members to ones of said second electrically conductive members.

wherein said connector is inserted between said first electronic part and said second electronic part, said intermediate basis material planarly-deflects at localized areas according to a load applied to bias said first electronic part or said second electronic part, whereby ones of said first electrically conductive members comes in contact with corresponding ones of said first terminals and ones of said second electrically conductive members comes in contact with corresponding ones of said second terminals, and ones of said first terminals are electrically connected to corresponding ones of said second terminals;

wherein said first electronic part is formed with a hole far determining a position of said connector, and said connector includes:

a frame portion secured to said first electronic part to support said intermediate basis material at a predetermined position, said frame portion being provided with a pin portion fixedly inserted in said hole of said first electronic part.

* * * * *